US006481665B2

(12) United States Patent
Walker

(10) Patent No.: US 6,481,665 B2
(45) Date of Patent: Nov. 19, 2002

(54) ROLL WEB STOCK FEEDER

(75) Inventor: Bruce W. Walker, Palm Bay, FL (US)

(73) Assignee: S2 Yachts Inc., Holland, MI (US)

( * ) Notice: Subject to any disclaimer, the term of this patent is extended or adjusted under 35 U.S.C. 154(b) by 41 days.

(21) Appl. No.: 09/725,601

(22) Filed: Nov. 29, 2000

(65) Prior Publication Data

US 2002/0063184 A1 May 30, 2002

(51) Int. Cl.[7] ..... B65H 16/08; B65H 75/00

(52) U.S. Cl. ..... 242/594.6; 242/557; 242/561; 242/594.1

(58) Field of Search ..... 242/594.6, 557, 242/558, 559, 560, 561, 566, 578, 590, 594, 594.1, 594.5, 595.1

(56) References Cited

U.S. PATENT DOCUMENTS 381,294 A * 4/1888 Tea
849,066 A * 4/1907 Hahn
993,416 A * 5/1911 Scott
1,189,380 A * 7/1916 Parker et al.
1,701,361 A * 2/1929 Elliott
2,382,332 A * 8/1945 Polgar ..... 242/55.2
2,656,050 A * 10/1953 Best et al. ..... 214/1
5,587,044 A * 12/1996 Goto ..... 156/577
6,095,454 A * 8/2000 Simmons, Jr. et al. ... 242/560.3
6,152,670 A * 11/2000 Onnerlov ..... 414/276

* cited by examiner

*Primary Examiner*—Donald P. Walsh
*Assistant Examiner*—Mark J. Beauchaine
(74) *Attorney, Agent, or Firm*—Price, Heneveld, Cooper, DeWitt & Litton

(57) ABSTRACT

A storage and dispensing bin has a plurality of vertically spaced chutes, each of which are capable of receiving a plurality of rolls of web stock material and dispensing material from an end-most roll through guides located at the desired vertical position with respect to a work surface. The chutes are inclined at angles to allow roll web stock to advance to a movable gate which allows the next roll of web stock in line to be advanced to a dispensing station when one roll is depleted. Each dispensing space station includes horizontally spaced rollers on which the web stock rests. A keeper bar extends in front of the web stock for holding it in placed as material is dispensed therefrom. A lateral stop is provided for holding the web stock, which may be of different widths, in predetermined horizontal alignment with respect to the work surface.

23 Claims, 4 Drawing Sheets

ROLL WEB STOCK FEEDER

BACKGROUND OF THE INVENTION

The present invention relates to a storage and feeding assembly for a plurality of rolls of web stock material and for dispensing web stock from sequential rolls of such material onto a work surface.

In the manufacture of products which employ rolls of web stock, it is desirable to continuously supply such web stock to, for example, a cutting machine for shaping the material into desired patterns for subsequent processing. The handling of roll web stock and the paying out of the web stock from a roll onto a work surface must be as continuous and uninterrupted as possible to improve the efficiency of the manufacturing process. Web stock typically can, depending on the nature of the material, be extremely heavy, weighing from 200 to 300 pounds or even more, and rolls of such web stock are cumbersome and difficult to handle. Once the stock is depleted from a conventional roll dispenser, it must be replaced. This is typically done manually, which requires several personnel.

In one industry, such as the boat manufacturing industry, web stock comprises woven fiberglass material which can be of various widths and densities depending upon the components being manufactured at a given time. Thus, it is also desirable to have the ability to quickly change the material supplied to a production line as different parts are manufactured. Other industries, such as those requiring woven fabrics for the manufacture of consumer products and the like, also utilize rolls of web stock material which may have different widths, textures, patterns, and the like. In any such industry, it is necessary, therefore, if using, for example, a common work surface with pattern cutting machines to have the ability to remove and replace relatively heavy rolls efficiently, such that a continuous supply of web stock is available for a given manufacturing operation.

Thus, there exists a need for a web stock feeding system which allows a substantially continuous supply of web stock to a work surface with minimum manual intervention, thereby speeding the manufacturing process and eliminating down time.

SUMMARY OF THE INVENTION

The system of the present invention satisfies this need by providing a roll web stock feeder assembly comprising a storage and dispensing bin having a plurality of vertically spaced chutes, each of which are capable of receiving a plurality of rolls of web stock material and dispensing material from an end-most roll through a guide located at the desired vertical position with respect to a work surface.

In a preferred embodiment of the invention, the chutes are inclined at angles to allow roll web stock to advance to a movable gate which holds the next roll of web stock in line to be advanced to a dispensing station when one roll is depleted. In a preferred embodiment also, the dispensing station includes horizontally spaced rollers on which the roll of web stock rests, thereby eliminating the need for a bar extending through the roll web stock. In a preferred embodiment, a keeper bar extends in front of the web stock for holding it in placed as material is dispensed therefrom. In a preferred embodiment also, a lateral stop is provided for holding the web stock (which may be of different widths) in predetermined horizontal alignment with respect to the work surface.

Also in a preferred embodiment of the invention, a plurality of bins can be provided and positioned in the work environment on rails, such that as the web stock from one bin is depleted, it can be replaced with a fully loaded bin. The bins can be preloaded with web stock utilizing forklifts and the like for handling the heavy web stock material and loading a plurality of rolls of such material into a feeder bin such that a sufficient number of rolls of web stock material can be preloaded into one or more bins prior to the operation of the assembly line to supply sufficient stock for a given run of an item to be manufactured.

These and other features, objects and advantages of the present invention will become apparent upon reading the following description thereof together with reference to the accompanying drawings.

DETAILED DESCRIPTION OF THE PREFERRED EMBODIMENT

Figure 1:
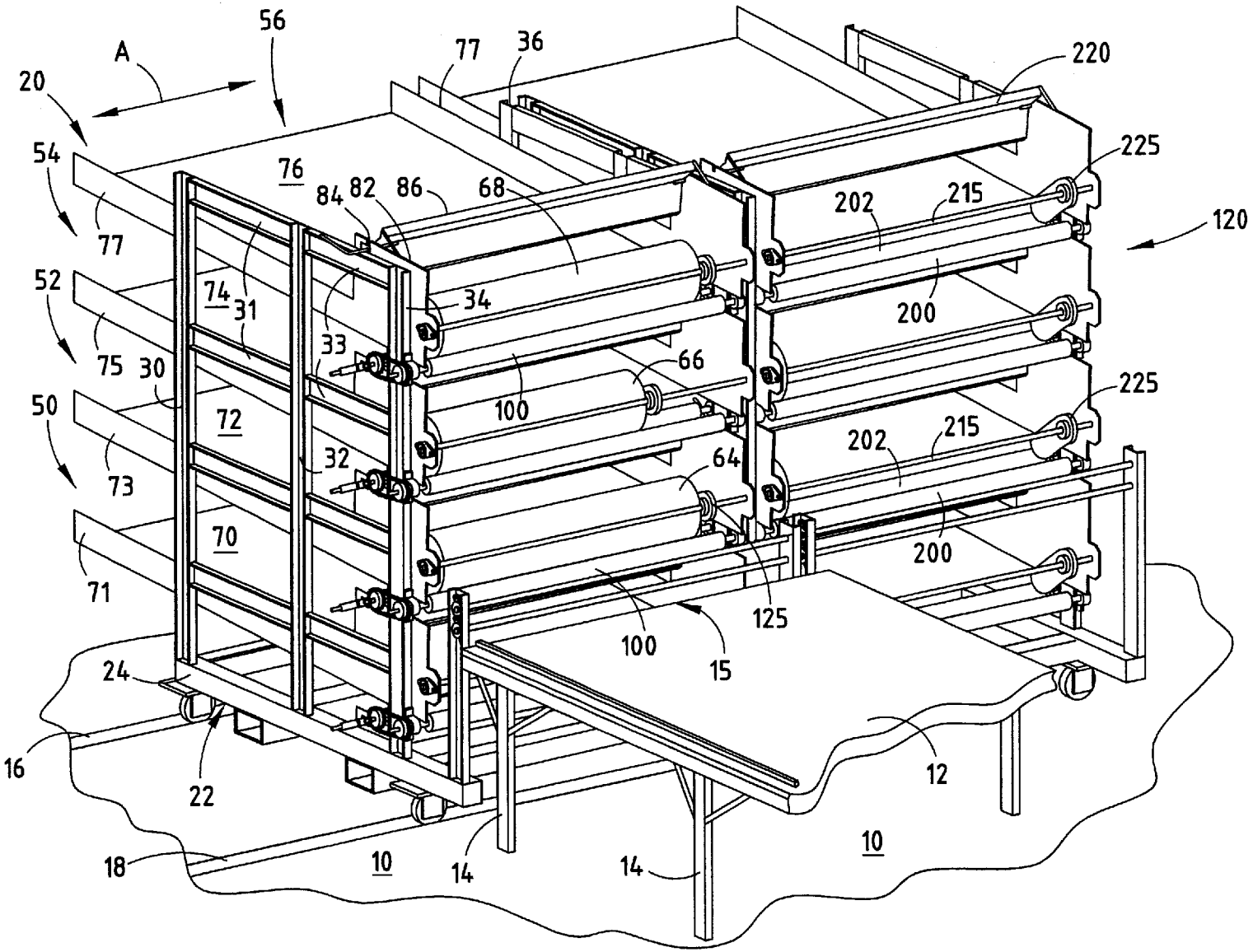
FIG. 1 is a perspective view of a manufacturing facility employing a roll web stock feeder for dispensing material onto a work surface.

Referring initially to FIG. 1, there is shown a manufacturing facility having a floor 10 onto which there is mounted a table having a work surface 12 supported above the floor by suitable support legs 14. The floor includes, at the input end 15 of work surface 12, a pair of laterally extending guide rails 16 and 18, which guidably support a plurality of roll web stock feeding bins, such as bins 20 and 120 shown in FIG. 1. Each of the bins 20 and 120, therefore, can move independently laterally in a direction indicated by arrow A in FIG. 1 in an aligned position with input end 15 of work surface 12 such that rolls of web stock contained in the bins, as described below, can be dispensed onto the work surface 12 from either bin 20 or bin 120 or additional bins which may be guided by tracks 16, 18 into an operative position, such as bin 20 shown in FIGS. 1 and 2.

The work surface 12 communicates with processing equipment, such as a computer numerically controlled (CNC) cutter which includes a feeder mechanism for grasping the web material and pulling it from the bins 20, 120 into position for a processing operation, such as cutting in one embodiment. Bins 20 and 120 are substantially identical, therefore, a description of only bin 20 is provided, it being understood that bin 120 includes substantially identical components.

Figure 3:
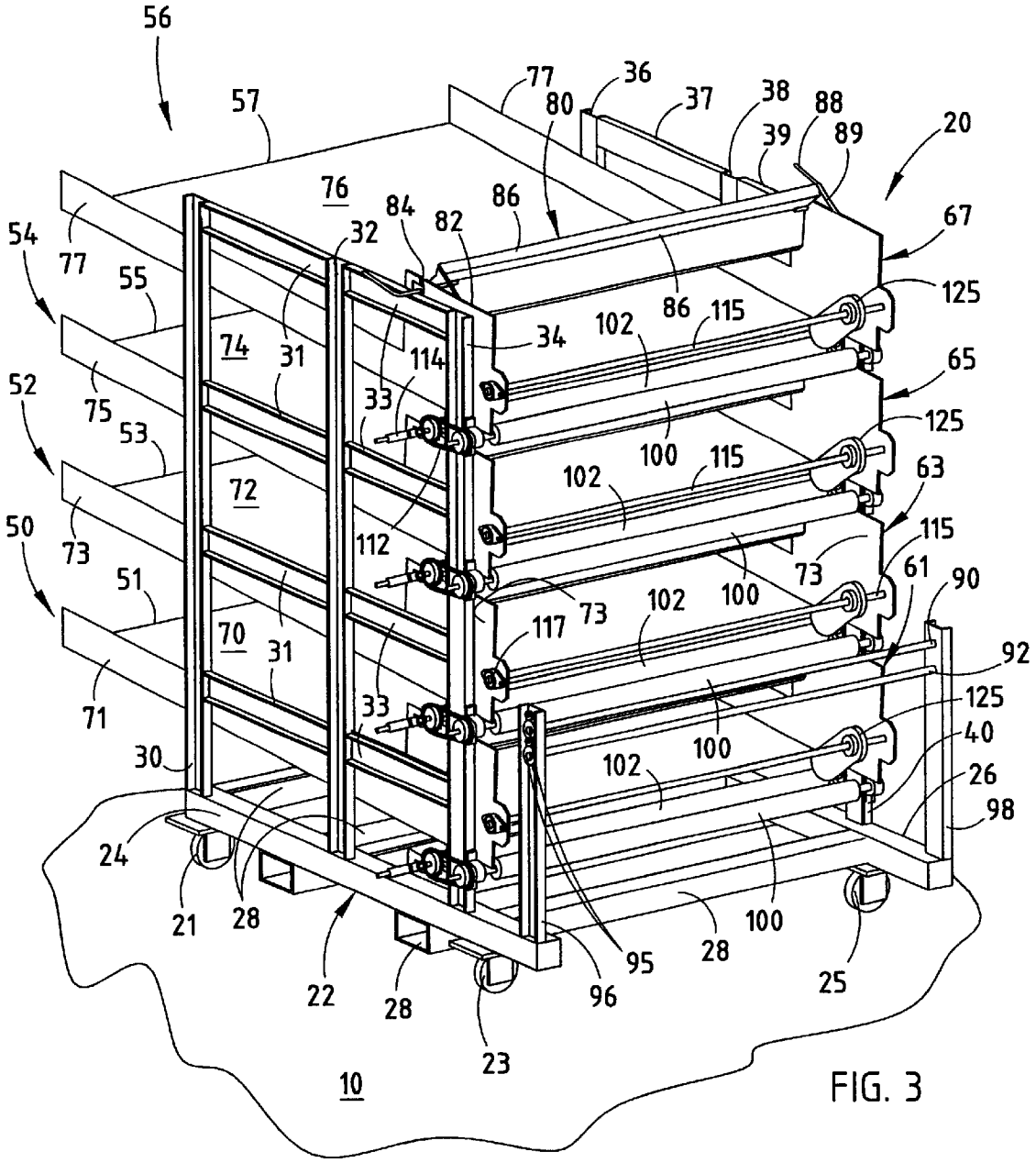
FIG. 3 is a front perspective view of the structure shown in FIGS. 1 and 2.

As best seen in FIG. 3, bin 20 includes a base 22 comprising a generally rectangular frame having longitudinally extending supports 24 and 26 joined with a plurality of cross members 28, such as channel irons, welded to provide a support for vertically extending risers 30, 32, and 34 on one side extending upwardly from support 24 and risers 36, 38, and 40 on the opposite side extending upwardly form support 26. Extending between the risers, which are made of suitable channel irons, are a plurality of cross members 31 and 33 on one side and 37 and 39 similarly positioned on the opposite side welded to define an open vertically extending framework extending upwardly from base 22 for supporting a plurality of chutes as described below. Base 22 includes four rollers or caster wheels 21, 23, 25, and 27 which are secured to end members 28 at the corners of base 22 and which ride along guide tracks 16, 18 for allowing bin 20 (and corresponding bin 120) to move laterally with respect to the end 15 of work surface 12.

Figure 2:
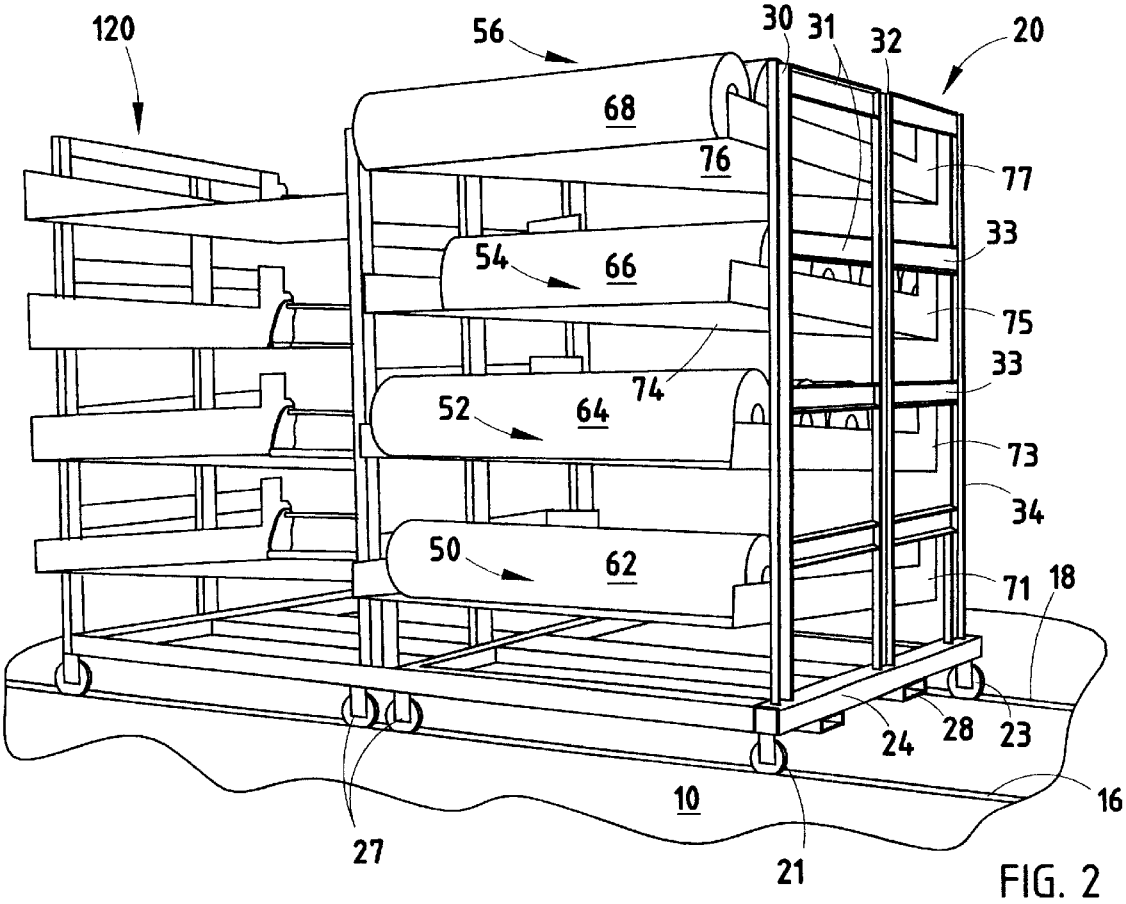
FIG. 2 is a rear elevational view of the structure shown in FIG. 1.

Bin 20 further includes, in the embodiment shown, four vertically spaced chutes 50, 52, 54, and 56, each having an input end 51, 53, 55, and 57, respectively, and a dispensing end 61, 63, 65, and 67, which is immediately adjacent end 15 of work surface 12. As best seen in FIG. 2, the input ends 51–57 are open to receive rolls of web stock material such as rolls 62, 64, 66, and 68, which rest upon a sheet metal pan 70, 72, 74, and 76 of chutes 50, 52, 54, and 56, respectively, with pans being integrally welded to sidewalls 71, 73, 75, and 77, respectively, to define the roll-supporting chutes. Pans 70, 72, 74, and 76 are inclined downwardly at an angle of from about 2° to 5° and preferably 3° from the input ends 51, 53, 55, and 57 to the dispensing ends 61, 63, 65, and 67 to allow the rolls to advance from the input end toward the dispensing end under the influence of gravity.

Each of the chutes includes a manually operated spring-loaded gate, such as gate 80 shown in FIG. 3 for bin 56. Gate 80 is positioned immediately behind dispensing end 67 to hold the next roll of web stock material in bin 56 from advancing into the discharge station until such time as the roll of web stock material currently in position has been dispensed. Gate 80 comprises a pivot rod 82 resting within a slot 84 formed in wall 77 at each end and a downwardly extending blade 86 which extends vertically and is positioned to hold a roll in position. Rod 82 terminates in a handle 88 at one end which can be employed to rotate blade 86 of gate 80 into a horizontal position for releasing the next of successive rolls of web material into a dispensing station. Blade 86 is normally held in a lowered position by a pair of springs 89, which bias the gate in a lowered or vertical position for holding roll stock material in the chutes away from the roll of material located in each dispensing station.

Each chute of bin 20, shown in FIG. 1, is adapted to accommodate up to at least 6 rolls of, for example, web fiberglass material used in the boat manufacturing industry such that bin 20 can accommodate up to 24 such rolls of varying width, as seen in FIG. 1, for the manufacture of different boat components. Depending upon the particular component being manufactured, each web in a chute may be of a different material, width, thickness, weave, and the like, with the webs employed in the manufacture of boat components typically being fiberglass material, which is commercially available from Brunswick Technology, with each roll being approximately 60 yards in length and weighting from 120 to 260 pounds. The maximum widths of the rolls in this embodiment is approximately 5 feet, corresponding to the width of the chutes 50, 52, 54, and 56, and the spacing between end walls 71, 73, 75, and 77, respectively, thereof. The bins 20, 120 can be scaled to accommodate wider rolls of web stock or each chute can accommodate a greater number of rolls.

Figure 6:
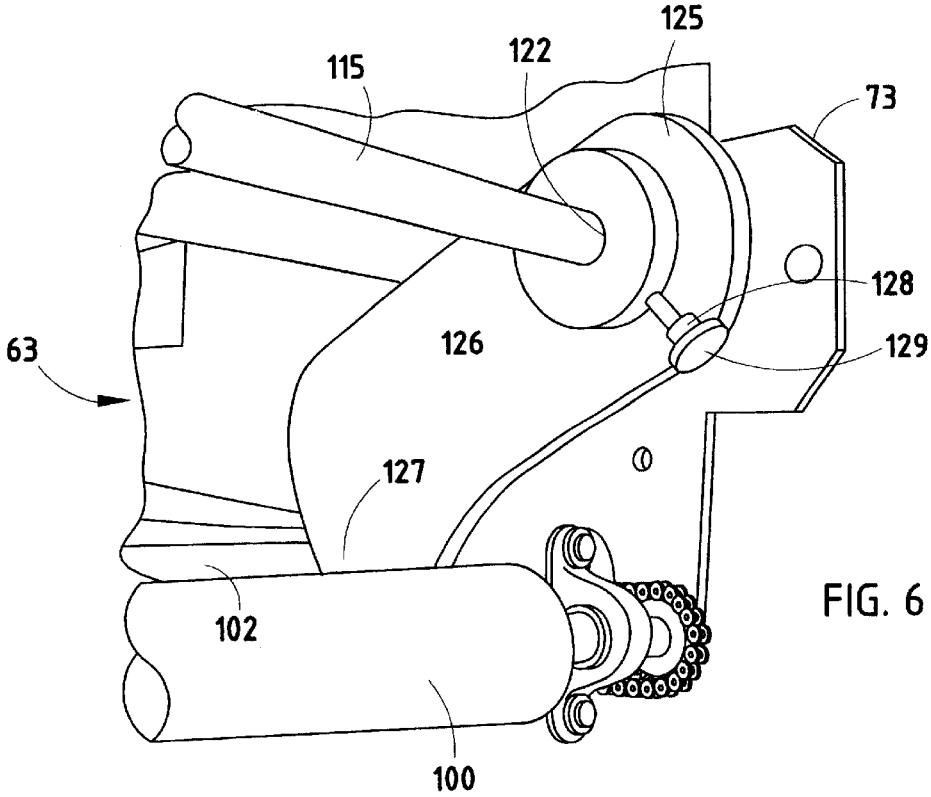
FIG. 6 is a fragmentary enlarged perspective view of a portion of the structure shown in FIG. 1, showing a lateral stop employed for holding a roll of web stock in a predetermined horizontal position.
Figure 4:
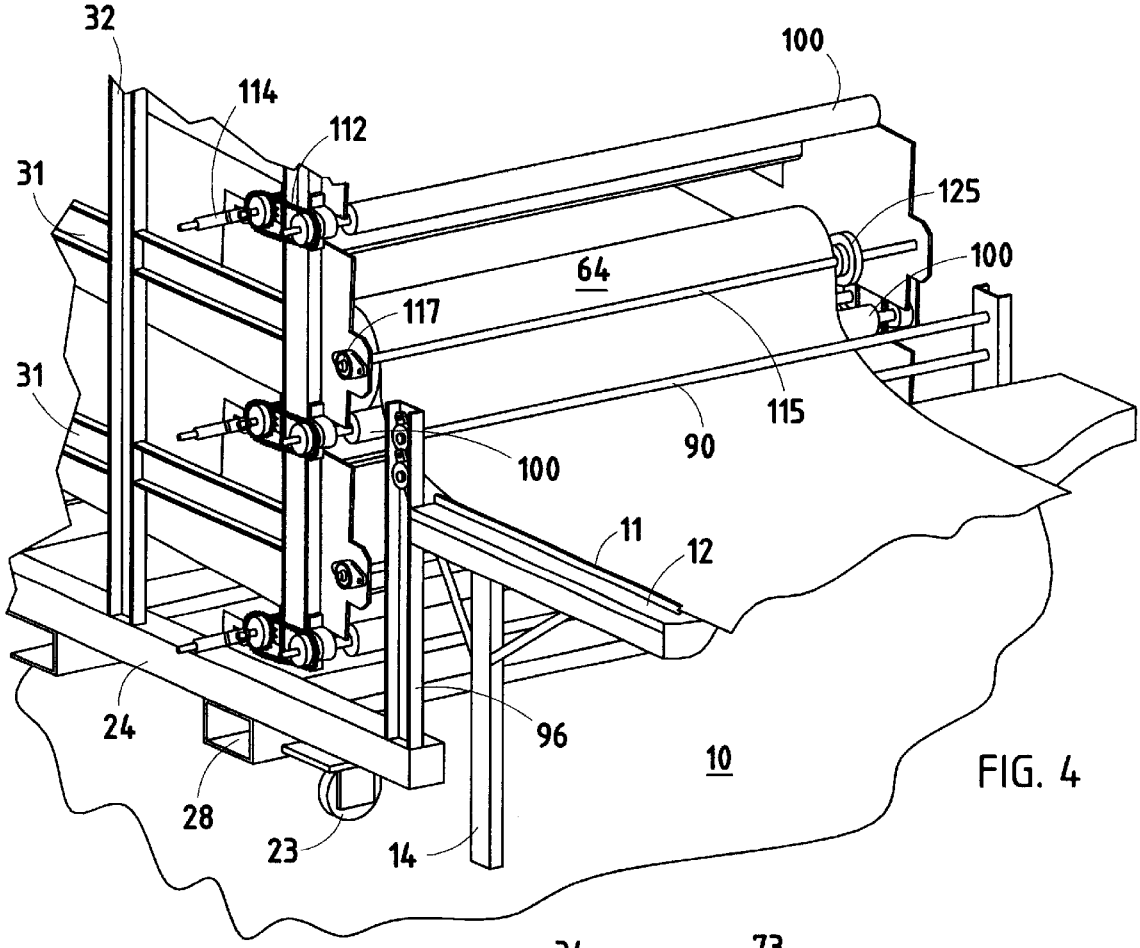
FIG. 4 is an enlarged fragmentary perspective view of a portion of the structure shown in FIGS. 1 and 3.
Figure 5:
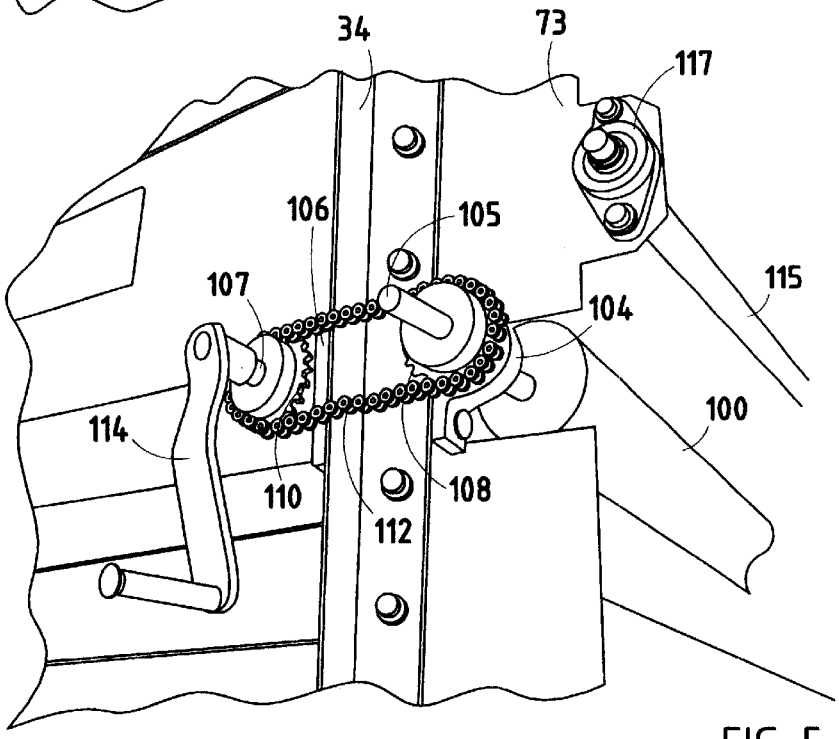
FIG. 5 is an enlarged fragmentary perspective view of a portion of the structure shown in FIG. 4.

Each of the dispensing stations 61, 63, 65, and 67 allow web stock material from a roll located in the dispensing stations, the details of which are described below, to supply web stock material through a pair of vertically spaced guide rollers 90 and 92 (FIGS. 3 and 4). Guide rollers 90 and 92 are rotatably mounted by bearings 95 mounted in vertical supports 96 and 98, extending upwardly from the ends of supports 24 and 26 at the discharge end of bin 20 with rollers 90 and 92 vertically positioned to align slightly above the work surface 12, as best seen in FIG. 4, such that a web of material, such as material from web 64, is guided by rollers 90 and 92 from a dispensing station such as station 63 onto the work surface 12. The dispensing stations 61, 63, 65, and 67 are each substantially identical and station 63, which is shown in detail in FIGS. 4–6, is described, it being understood that each of the chutes 50, 52, 54, and 56 include a substantially identical construction for allowing the web stock material to be payed out from the roller at the dispensing station onto the work surface. Each dispensing station is substantially identical so that only one station (63) is now described in detail.

Dispensing station 63 comprises a pair of rollers 100 and 102 (FIGS. 3–5), typically made of a smooth polymeric material such as nylon or other suitable material molded onto their axles 105 and 107. The rollers are horizontally spaced a distance to support a roll of web stock material when in its largest and smallest diameter as the material is dispensed therefrom. Axles 105 and 107 are supported between opposed end walls 73 of chute 53 by means of roller bearings 104, 106 mounted to vertical supports 34 and 40, respectively, as best seen, for example, in FIG. 5. Axles 105 and 107 include chain sprockets 108 and 110 between which there is mounted a coupling chain 112 for rotatably coupling rollers 100 and 102 such that a handle 114 can be mounted to one of the axles, such as axle 107 which may include a flat for receiving a keyed socket on handle 114 for manually rewinding web material at the end of a production run back onto the roll 64 of such web material. The rollers 100, 102 in one embodiment have a diameter of, for example, approximately 2 inches and are spaced approximately 8 inches from center to center so that a roll of web stock 64, for example, can rest between the two rollers and freely pay out web stock material therefrom. Positioned in front and above the rollers, as best seen in FIGS. 3–5 is a keeper bar 115 which prevents a roll of web stock material from leaving the dispensing station. Keeper bar 115 is rotatably mounted to the forward end of member 73 by roller bearings 117 and 118 at opposite ends thereof to allow the keeper bar to rotate when and if engaged by a rotating roll of web stock.

Movably coupled to each of the keeper bars 115, as seen in FIG. 1, for example, and as best seen in FIG. 6, is a lateral stop 125 comprising a somewhat L-shaped polymeric body 126 having a tip end 127 which is rotated downwardly and adjacent a side of a roller, such as roller 64, 66, 68 (as seen in FIG. 1) to engage the end of the roll of web stock material remote from the left side of the bin, as seen in FIG. 1, to accommodate different widths of roll stock. For such purpose, the lateral stop 125 includes a lock nut 128 with a handle 129 thereon to allow its convenient adjustment. Stop 125 includes an axial opening 122 with a sleeve bearing therein to allow the stop to be moved laterally along the length of keeper bar 115 and, once laterally adjusted, allows the rotation of bar 115 within stop 125.

With the system shown in the figures, a bin, such as bin 20, can be preloaded with up to 24 rolls of web stock material of different size, texture, weave, widths, and the like for use on the work surface 12. The preloaded bin can then be shifted into an operative position, as shown in FIG. 1 adjacent end 15 of the work surface and a desired web is manually fed through the guide rods 90, 92 onto the work surface and into the manufacturing device, such as a CNC machine, which draws the web stock from the roll for a manufacturing operation to be performed thereon. The stop 125 is adjusted to hold the web stock in a laterally aligned position with respect to work surface 12, which may include a lateral guide edge 11 (FIG. 4). As the web material is withdrawn from the roll, support rollers, such as rollers 100 and 102, for each of the chutes being employed rotate, allowing the roll of web material to unwind and being maintained in position over the rollers by keeper bar 115. Bin 120 corresponds in construction to bin 20 and includes a pair of spaced rollers 200, 202 at each dispensing station, as well as a keeper bar 215 and lateral stop 225. Typically, the web stock will be wound on a cylindrical fiberboard core which, when all of the web stock has been depleted, can drop through the open space between rollers 102 and 104 or forward or rearward of the rollers out of the way and gate 80 raised by the actuation of handle 88 to advance by gravity the next roll of web stock into the dispensing station 63.

Thus, with the feeding apparatus of the present invention, sequential rolls of web stock can be easily and quickly supplied to a work station, requiring minimum intervention and handling by an operator, such that a single individual can maintain a continuous supply of web stock for a manufacturing operation.

It will become apparent to those skilled in the art that various modifications to the preferred embodiment of the invention as described herein can be made without departing from the spirit or scope of the invention as defined by the appended claims.

The invention claimed is:

1. A roll web stock feeding assembly comprising:

a bin having a plurality of vertically spaced chutes for receiving rolls of web stock material therein;

a dispensing station located at one end of each chute and including roller supports for allowing a roll of web stock to pay out web stock therefrom; and a guide positioned adjacent said dispensing station for guiding web stock payed from a roll of web stock onto a work surface.

2. The assembly as defined in claim 1 wherein each chute has a length for allowing storage of a plurality of rolls of web stock material.

3. The assembly as defined in claim 2 wherein each of said chutes are inclined downwardly from an end opposite said dispensing station toward said dispensing station.

4. The assembly as defined in claim 3 wherein said roller supports of said dispensing station comprise a pair of horizontally spaced rollers on which a roll of web stock material is supported for rotation thereon.

5. The assembly as defined in claim 4 wherein each chute includes a movable stop gate for selectively advancing rolls of web stock material into said dispensing station.

6. The assembly as defined in claim 5 wherein said rollers include axles having sprockets mounted thereto coupled by a chain drive and further including a crank arm for coupling to at least one of said axles such that web stock material can be rewound onto a roll.

7. The assembly as defined in claim 6 wherein said assembly includes a base having a plurality of wheels thereon and wherein said wheels are adapted to transport said assembly along tracks in the floor of a manufacturing facility for positioning the assembly in alignment with a work station.

8. A system for providing a continuous supply of web stock material to a work station in a manufacturing facility comprising:

a work station mounted to a floor of a manufacturing facility;

a pair of parallel, spaced-apart rails mounted in the floor of the manufacturing facility and extending in orthogonal relationship adjacent an input end of said work station;

a plurality of storage and dispensing bins, each having a plurality of vertically spaced dispensing chutes for receiving a plurality of rolls of web stock material in sequence as a roll of web stock material is depleted, such that said work station can receive a substantially continuous supply of web stock material for processing.

9. The system as defined in claim 8 and further including a web guide for receiving web stock material from any of said chutes and positioning the web stock material in predetermined alignment with said work station.

10. The system as defined in claim 9 wherein each of said chutes are inclined downwardly from an end opposite said dispensing station toward said dispensing station.

11. The system as defined in claim 10 wherein each of said chutes include a dispensing station including a pair of horizontally spaced rollers for rotatably supporting rolls of web stock.

12. The system as defined in claim 11 wherein each chute includes a movable stop gate for selectively advancing rolls of web stock material into said dispensing station.

13. The system as defined in claim 12 wherein said rollers include axles having sprockets mounted thereto coupled by a chain drive and further including a crank arm for coupling to at least one of said axles such that web stock material can be rewound onto a roll.

14. The system as defined in claim 8 wherein each chute includes an input end for receiving rolls of web stock material and a dispensing end remote from said input end.

15. The system as defined in claim 14 wherein each of said chutes are inclined downwardly from an end opposite said dispensing station toward said dispensing station.

16. The system as defined in claim 15 wherein each chute includes a movable stop gate for selectively advancing rolls of web stock material into said dispensing station.

17. A storage and dispensing bin for roll web stock comprising:

a bin having a plurality of vertically spaced chutes, each with an input end for receiving rolls of web stock material therein;

a dispensing station located at an end of each chute opposite said input end and including supports for allowing a roll of web stock to pay out web stock therefrom; and a movable stop gate mounted to each chute for selectively advancing rolls of web stock material into said dispensing station.

18. The bin as defined in claim 17 and further including a guide positioned adjacent said dispensing station for guiding web stock payed from a roll of web stock onto a work surface.

19. The bin as defined in claim 18 wherein each chute has a length for allowing storage of a plurality of rolls of web stock material.

20. The bin as defined in claim 19 wherein each of said chutes are inclined downwardly from said input end toward said dispensing station.

21. The bin as defined in claim 20 wherein said supports of said dispensing station comprise a pair of horizontally spaced rollers on which a roll of web stock material is supported for rotation thereon.

22. A storage and dispensing bin for roll web stock comprising:

a bin having a plurality of chutes, each with an input end for receiving rolls of web stock material therein, wherein each chute has a length for allowing storage of a plurality of rolls of web stock material, wherein said bin includes a base having a plurality of wheels thereon and wherein said wheels are adapted to transport said bin along tracks in the floor of a manufacturing facility for positioning the bin in alignment with a work station;

a dispensing station located at an end of each chute opposite said input end and including supports for allowing a roll of web stock to pay out web stock therefrom and further including a guide positioned adjacent said dispensing station for guiding web stock payed from a roll of web stock onto a work surface, wherein each of said chutes are inclined downwardly from said input end toward said dispensing station and wherein said supports of said dispensing station comprise a pair of horizontally spaced rollers on which a roll of web stock material is supported for rotation thereon; and a movable stop gate mounted to each chute for selectively advancing rolls of web stock material into said dispensing station.

23. The bin as defined in claim 22 wherein said spaced rollers include axles having sprockets mounted thereto coupled by a chain drive and further including means coupled to one of said axles such that web stock material can be rewound onto a roll.

* * * * *